US005488220A

United States Patent [19]

Freerks et al.

[11] Patent Number: 5,488,220

[45] Date of Patent: Jan. 30, 1996

[54] BAG FOR MICROWAVE COOKING

[75] Inventors: Randall C. Freerks, Little Rock; Marvin A. Strouth, Ashton, both of Iowa

[73] Assignee: Union Camp Corporation, Princeton, N.J.

[21] Appl. No.: 282,647

[22] Filed: Jul. 29, 1994

[51] Int. Cl.[6] ..... H05B 6/80

[52] U.S. Cl. ..... 219/727; 219/730; 426/107; 426/234

[58] Field of Search ..... 219/727, 730; 99/DIG. 14; 426/107, 109, 111, 113, 234, 243; 383/93, 94

[56] References Cited

U.S. PATENT DOCUMENTS

| | | | |
|---|---|---|---|
| 3,023,947 | 3/1962 | McDuffie . | |
| 3,987,959 | 10/1976 | Deards et al. . | |
| 4,176,746 | 12/1979 | Kooi . | |
| 4,450,180 | 5/1984 | Watkins . | |
| 4,691,374 | 9/1987 | Watkins et al. . | |
| 4,810,844 | 3/1989 | Anderson | 219/727 |
| 4,851,246 | 7/1989 | Maxwell et al. . | |
| 4,892,744 | 1/1990 | Ylvisaker | 426/111 |
| 4,950,859 | 8/1990 | Anderson . | |
| 4,973,810 | 11/1990 | Brauner | 219/727 |
| 5,011,299 | 4/1991 | Black, Jr. et al. . | |
| 5,044,777 | 9/1991 | Watkins et al. | 219/727 |
| 5,181,365 | 1/1993 | Garvey et al. . | |
| 5,189,272 | 2/1993 | McDonald et al. | 219/727 |
| 5,190,777 | 3/1993 | Anderson et al. . | |
| 5,195,829 | 3/1993 | Watkins et al. . | |
| 5,200,590 | 4/1993 | Bowen et al. . | |
| 5,211,975 | 5/1993 | Mendenhall et al. . | |
| 5,214,257 | 5/1993 | Riskey . | |
| 5,223,288 | 6/1993 | Mendenhall et al. . | |
| 5,227,599 | 7/1993 | Mason et al. . | |
| 5,244,682 | 9/1993 | Happ . | |
| 5,284,666 | 2/1994 | Graf . | |
| 5,294,764 | 3/1994 | Mass . | |
| 5,294,765 | 3/1994 | Archibald et al. . | |
| 5,302,790 | 4/1994 | Turpin . | |
| 5,306,512 | 4/1994 | Blamer . | |
| 5,314,252 | 5/1994 | Happ . | |
| 5,317,118 | 5/1994 | Brandberg et al. . | |
| 5,326,576 | 7/1994 | Zuege | 426/107 |

*Primary Examiner*—Philip H. Leung
*Attorney, Agent, or Firm*—Dennis H. Lambert

[57] ABSTRACT

A bag for popping popcorn in a microwave oven has substantially rectangular front and back face panels and gusseted side panels joining the opposite side edges thereof. Top and bottom ends of the bag are normally closed and sealed, but the top end may be opened to remove the contents of the bag. The gusseted side panels unfold during cooking to enlarge the interior volume of the bag, forming triangularly shaped corner flaps at the junctures of the side panels and the front and back panels, respectively. In conventional bags, the confronting surfaces between the triangularly shaped panels of the corner flaps move apart when the side panels unfold and the bag expands during cooking, forming pockets between the confronting surfaces in which food particles may become trapped. In the invention, spots of adhesive are placed between these confronting surfaces to hold them in contiguous relationship to one another and prevent the formation of pockets, thereby enhancing the yield of food cooked in the bag. In a preferred construction, the spots of adhesive are placed between these confronting surfaces only at the back panel and only at the closed bottom end of the bag.

18 Claims, 4 Drawing Sheets

BAG FOR MICROWAVE COOKING

FIELD OF THE INVENTION

This invention relates in general to a container for storing and cooking food. More particularly, the invention relates to a container for receiving, storing and popping a quantity of popcorn kernels in a microwave oven.

BACKGROUND OF THE INVENTION

There are many known containers for storing and cooking food, including microwavable bags for popping popcorn. Such bags typically have a microwave susceptor in one panel for absorbing microwave energy and heating the contents of the bag. Further, such bags typically have gusseted side panels which enable the bag to be folded flat for storage and shipment but which unfold and enable the bag to expand when the food inside the bag is cooked. These gusseted side panels usually terminate at folded end flaps at the opposite end corners of the bag, and in conventional bags these end flaps define interior pockets or shelves as the bag expands and the gusseted side panels unfold. These pockets or shelves then define areas into which uncooked food, especially unpopped kernels of corn, may migrate and be held away from the source of heat, whereby these pieces of food will remain uncooked. In a conventional popcorn bag, 9 grams or more of unpopped kernels may remain in the bag after the popcorn is cooked, at least partially due to the kernels migrating into the pockets or shelves defined by the corner flaps at opposite ends of the bag.

Attempts have been made in the prior art to solve this problem, as exemplified, for example, in U.S. Pat. No. 4,810,844, issued Mar. 7, 1989, to Alan R. Anderson; U.S. Pat. No. 5,044,777, issued Sep. 3, 1991, to Jeffrey T. Watkins, et al.; and U.S. Pat. No. 5,326,576, issued Jul. 5, 1994, to John C. Zuege. Anderson describes a system in which the bag is constructed to be stood on its side, with triangularly shaped corner sections 14 defined by bonding the panels of the bag together in the corners, Watkins provides diagonally extending adhesive patches 64–67 and 68–72 at opposite ends of the bag to close off the pockets or shelves that might otherwise be formed by corner flaps at opposite ends of the gusseted side panels, and, Zuege provides attachment means 24, 24' in the seamed area of bag closure means 26 at the open or top end of the bag to hold the gusseted side panels together and maintain the food to be cooked adjacent the heat enhancer to provide uniform and complete cooking of the food.

The microwave popcorn package described by Anderson departs from the usual "pillow" or "lunch bag" style most normally employed in that it does not incorporate gusseted side panels, and is constructed to stand on its side during cooking of food therein. To this end, the corners of the bag, at least at one side, are flattened and secured together so that they extend outwardly in opposite horizontal directions to help stabilize or support the bag on its side.

Watkins, et al. describe a popcorn bag of the more usual "pillow" style having gusseted side panels and an upper end that may be opened to dispense the popped popcorn. However, this package utilizes a large amount of adhesive to effect the seals at the top and bottom ends of the bags, especially the diagonal patches of adhesive that are incorporated to close the gusseted side panel flaps or pockets at opposite ends of the bag.

Zuege describes a microwave popcorn bag of essentially conventional construction, except for the attachment means 24, 24' provided between the gusseted panels at the upper end of the bag in the area of closure means 26. These attachment means, which may comprise patches of adhesive, are used to secure the upper end of the bag in the configuration shown in FIG. 4 prior to filling, and purport to close the pockets or shelves at the upper end of the bag during popping of the popcorn in the bag.

Consequently, a need exists for an inexpensive and effective way of preventing formation of the pockets or shelves defined by the corner flaps at the gusseted side panels of a bag used to cook food in a microwave oven, to avoid or minimize entrapment of food particles in such pockets which might otherwise form during cooking of food in the bag, thereby increasing the yield of food cooked in the bag as compared with the yield obtained in conventional bags.

SUMMARY OF THE INVENTION

In accordance with the present invention, means is provided to close the pockets or shelves normally defined at the closed end of the gusseted side panels in a typical "pillow" style bag used for the microwave cooking of food.

More specifically, the means provided by the invention for closing the pockets that are normally formed between the gusseted side panels and the front and back panels of the bag at its closed end comprise small spots of adhesive applied either to the side panel and/or to the front and/or back panel of the bag closely adjacent the diagonal fold line or edge of the corner flap that is normally formed by the gusseted side panel as it expands outwardly during cooking of the food within the bag. The front panel of the bag in the present invention contains a microwave susceptor, and in use this front panel is normally positioned downwardly or lower than the other sides. By adhesively securing at least one portion of the gusseted side panel at each side of the bag to an adjacent one of the front and/or back panels of the bag, separation of the side panel from its flattened position contiguous to the front or back panel is prevented, thereby preventing the formation of pockets in which food particles may become trapped. In the present invention, the spots of adhesive are preferably placed between the corner flaps and the back panel, opposite the side containing the susceptor, whereby substantially all of the food in the bag is enabled to fall into the area of the microwave susceptor so that it can be cooked.

The spots of adhesive, being placed adjacent the diagonal fold line at the closed end of the gusseted side panels will be referred to hereinafter as "mitre spots". Although these mitre spots may be placed between the panels of the corner flaps of the gusseted side panels at both the front and back panels of the bag, it has been found that the invention works nearly as well if only two mitre spots are provided between the flaps of the gusseted side panels and only the back panel of the bag. This appears to be due to the fact that the retention in a closed position of the corner flap portion of the gusseted side panel adjacent the back panel of the bag serves also to limit the formation of pockets adjacent the front panel of the bag during cooking of the food therein, thereby eliminating the pockets at both the front and back of the bag. Further, even if small pockets should form at the front panel, the orientation of these pockets enables uncooked food particles to fall by gravity back toward the suscepter. There is some improvement, however, if mitre spots are used between the gusseted side panels at both the front and back panels of the bag, and this approach may be utilized if desired. For instance, a bag having no means for eliminating the pockets that form between the gusseted side panels and back and front panels of the bag may result in 9 grams or more of unpopped kernels when used to cook popcorn in a microwave oven. If 2 mitre spots of adhesive are used in accordance with the invention to attach the corner flaps of the gusseted side panels to the back panel of the bag, only approximately 5 grams of unpopped kernels will remain, and if 4 mitre spots are used to attach the gusseted side panels to both the front and back panels of the bag, only approximately 3½ grams of unpopped kernels will remain.

Further, it has been discovered that use of the mitre spots in accordance with the invention enables elimination of the "tuck adhesive" normally applied in sealing the bottom end of the bag, thereby reducing the amount of adhesive required in the manufacture of the bag. A slight improvement in yield of cooked food is achieved if the tuck adhesive is utilized, however, and its use may be continued in a conventional way if desired. Additionally, the mitre spots are used to close the pockets at the bottom end of the bag, whereby they do not interfere with opening of the bag following cooking of the food therein.

In a preferred construction, the mitre spots comprise a flowable adhesive which is applied to the bag in a flowable condition so that when the panels are folded upon one another and pressed to seal them together, the mitre spots will automatically adjust to the positioning of the diagonal fold lines of the corner flaps between the front and/or back panels and the gusseted side panels, thereby ensuring that these areas of the bag are appropriately secured together to eliminate the formation of any pockets which might otherwise form and potentially collect food particles.

Other than the incorporation of two or more mitre spots as described above, the bag of the invention is constructed conventionally and functions normally during filling, cooking and dispensing of food cooked therein, except that utilization of the mitre spots results in a substantially higher yield of cooked food than is achieved with a conventional bag.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein.

DETAILED DESCRIPTION OF THE PREFERRED EMBODIMENTS

Referring more specifically to the drawings, a bag in accordance with the invention is indicated generally at 10 in FIGS. 1–7. The bag includes a pair of generally rectangular front and back face panels 11 and 12, respectively, joined at opposite side edges by gusseted side panels 13 and 14.

Figure 1:
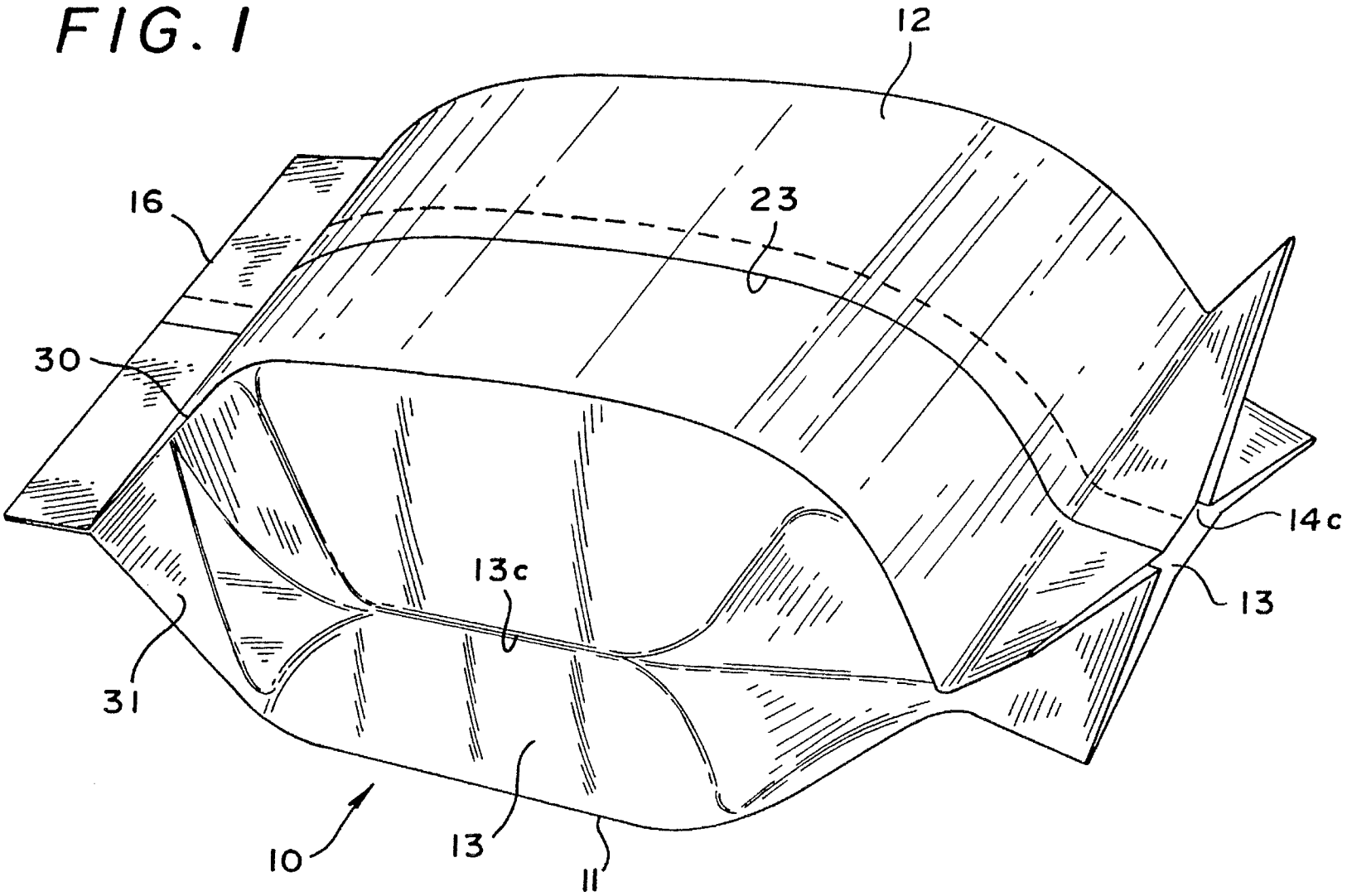
FIG. 1 is a top perspective view of a bag for microwave cooking of popcorn incorporating the features of the invention therein.
Figure 2:
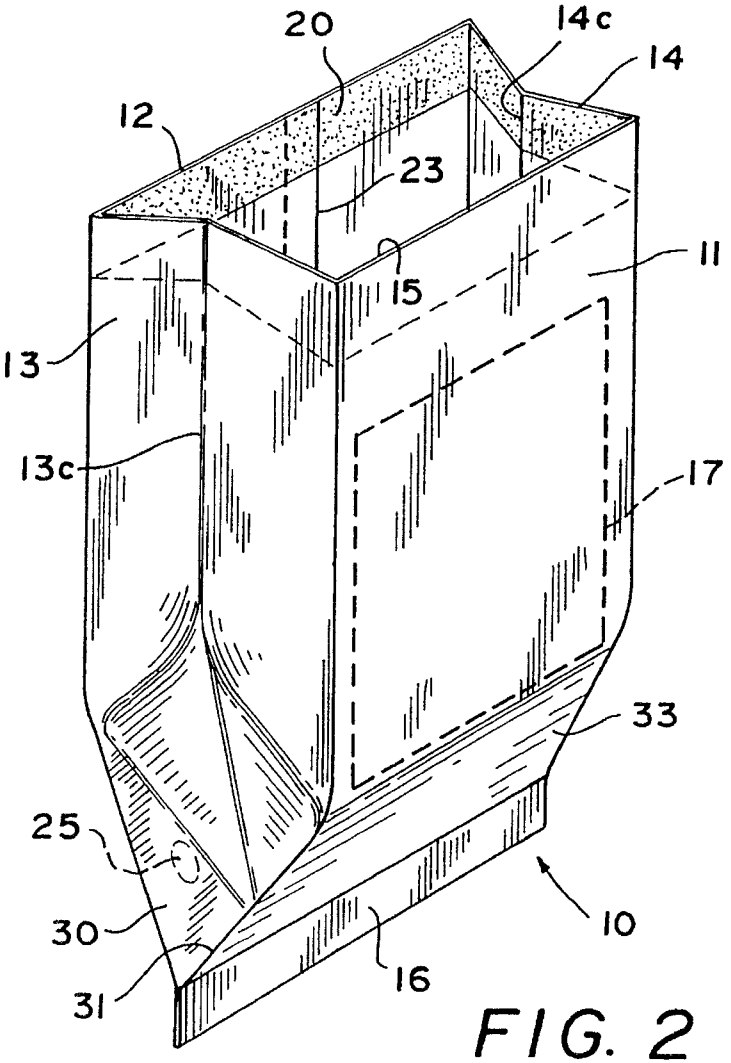
FIG. 2 is a top perspective view of the bag of FIG. 1, shown in an upright position with the upper end open for removing cooked food from the bag.
Figure 3:
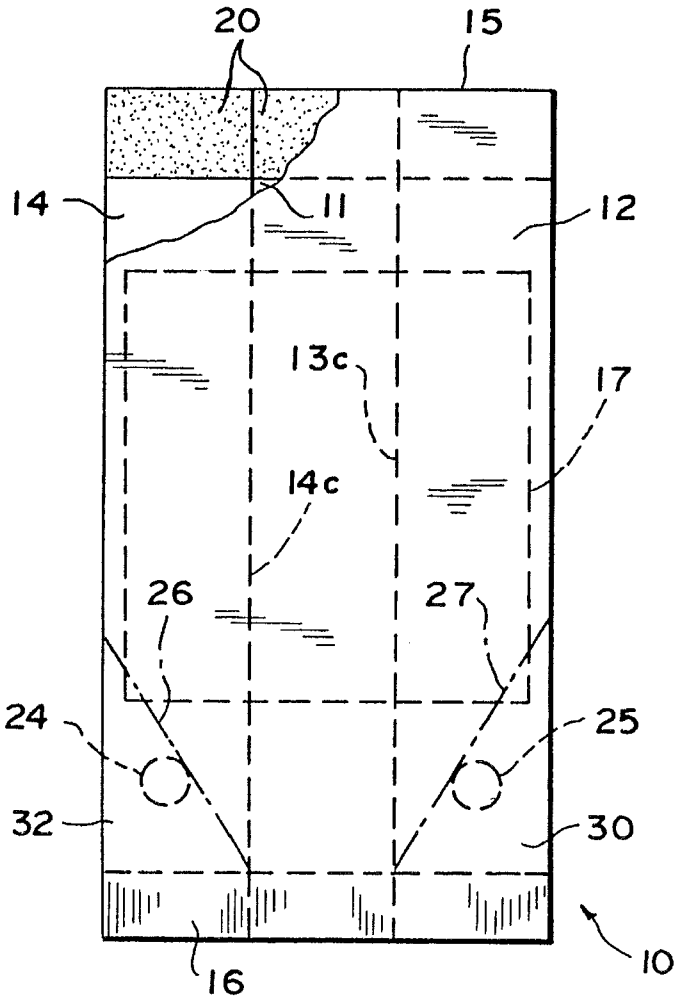
FIG. 3 is a plan view of the bag of FIGS. 1 and 2, shown in its flattened or unexpanded condition.
Figure 4:
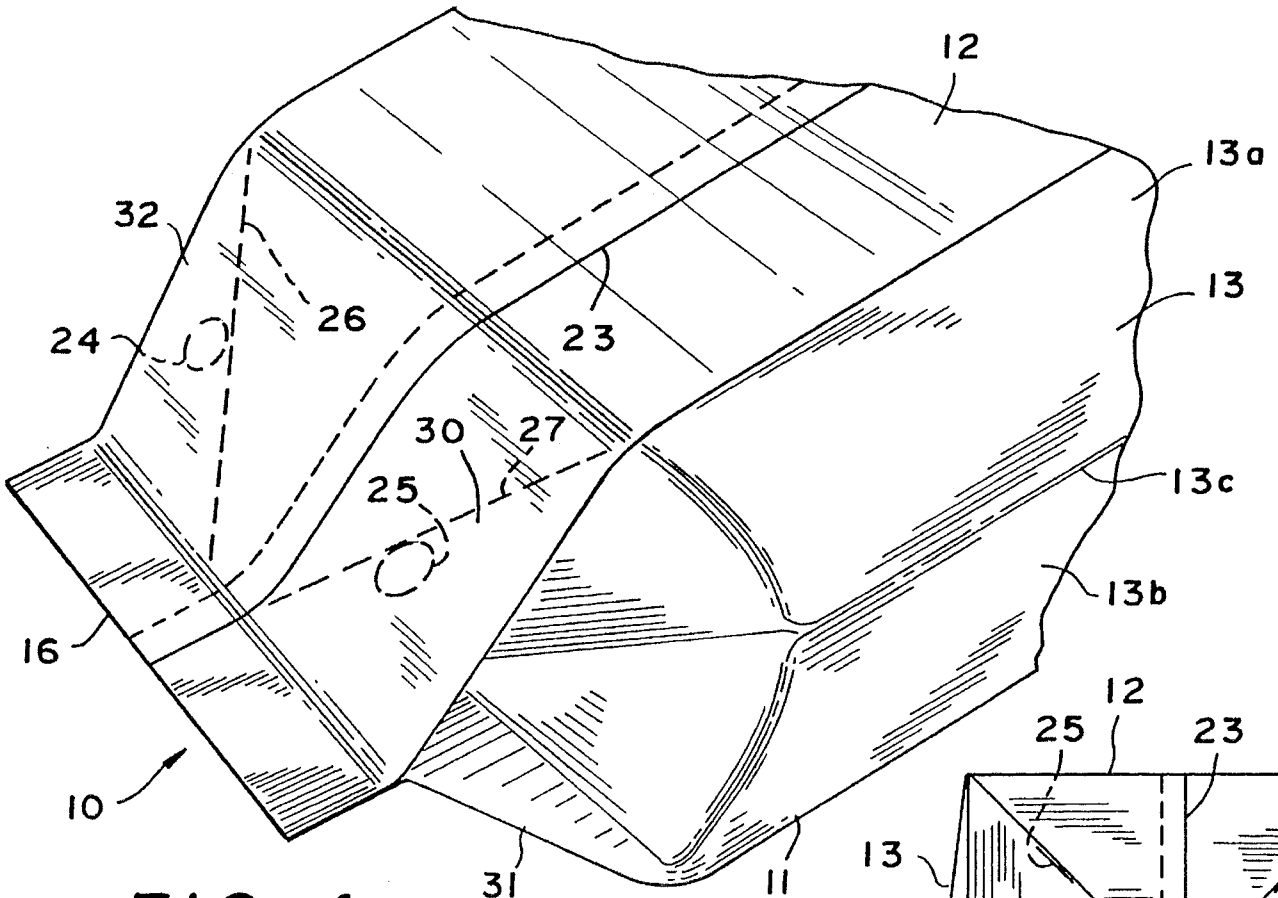
FIG. 4 is an enlarged fragmentary perspective view of the bottom end of the bag, showing the relationship of the mitre spots to the diagonal fold lines of the corner flaps of the gusseted side panels.
Figure 5:
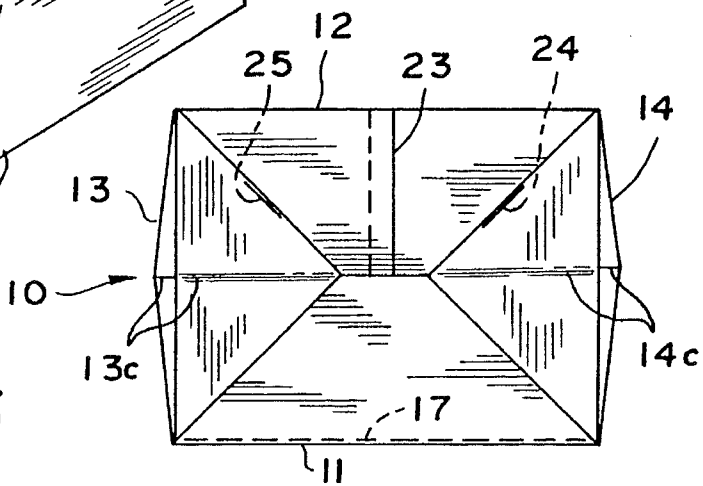
FIG. 5 is an end view looking into the open end of the bag toward the closed bottom, and showing how the bottom is configured without any pockets formed in the areas of the corner flaps because of use of the mitre spots.
Figures 6, 7:
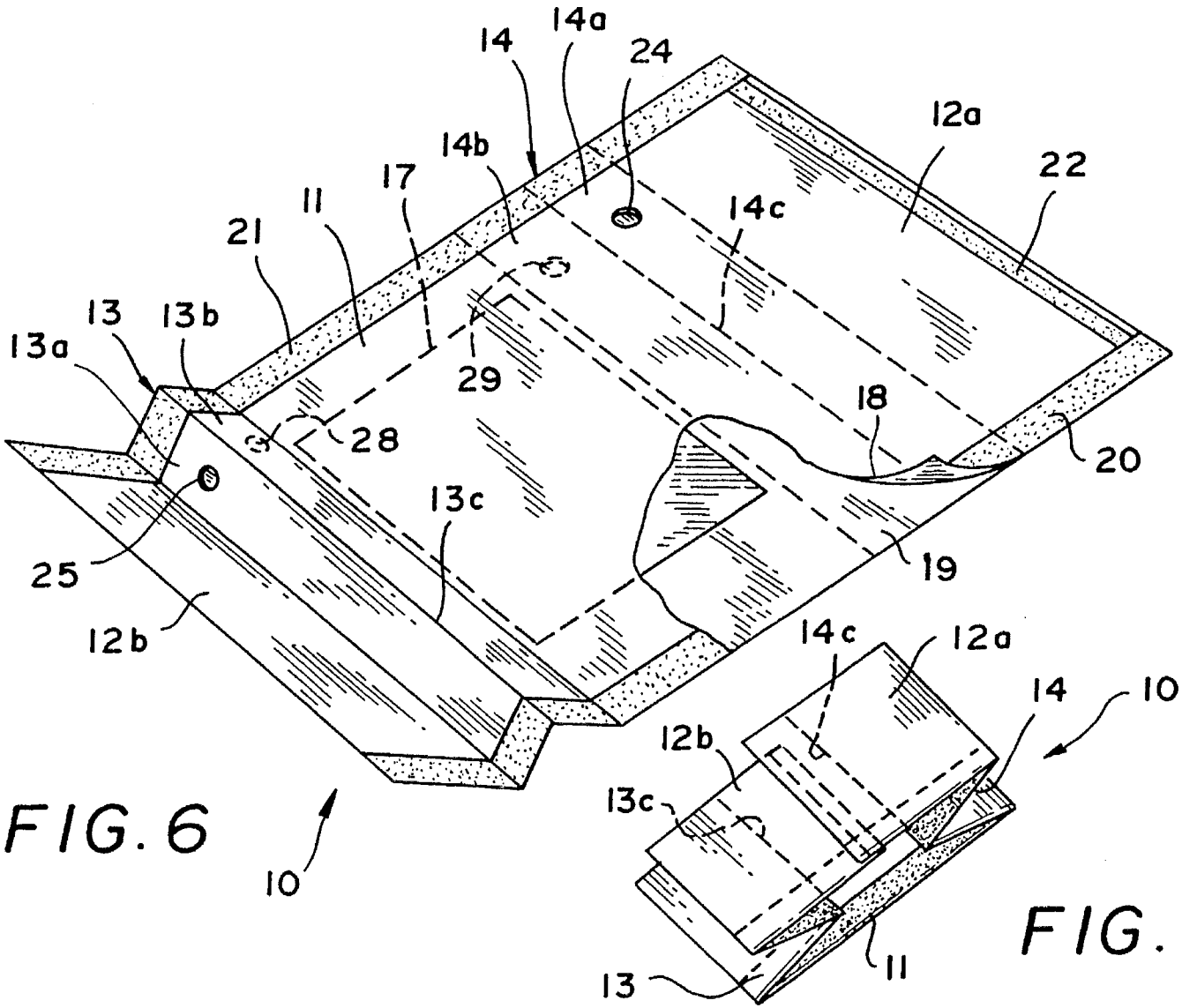
FIG. 6 is a top perspective view of the bag of the invention prior to being folded and assembled to make the bag of FIG. 1, with portions broken away to show the multiple layers used in its construction.
FIG. 7 is fragmentary perspective view showing the open end of the bag after it has been folded into operative position but before the confronting sections are pressed together to seal the adhesive and close the open end of the bag.

With particular reference to FIGS. 3, 4 and 6, the gusseted side panels 13 and 14 each comprises first and second side panel portions 13*a*, 13*b* and 14*a*, 14*b*, respectively, joined along fold lines 13*c* and 14*c*, respectively, whereby the gusseted side panels may be folded inwardly with an accordion pleat so that the side panels lie between the front and back panels when the bag is in its fully folded, collapsed position as depicted in FIGS. 3 and 7.

During manufacture of the bag, the front and back panels and gusseted side panels are pressed together at the bottom end 16 and adhesively secured to close and seal the bottom end of the bag. See FIG. 2, wherein the bag is shown expanded for the purpose of illustrating other features of the invention.

The bag may have a conventional heat enhancer or microwave susceptor 17 in one side. In use, this side of the bag is placed downwardly or lower than the other sides so that the food contained in the bag rests on or closely adjacent the susceptor to facilitate heating and cooking of the food contained in the bag when the bag is placed in a microwave oven.

Following manufacture of the bag, and prior to filling it with the food to be cooked, the bag is shipped in its flattened or collapsed condition to a suitable facility for filling the bag with food to be cooked. Prior to placing the food in the bag, approximately one-third of the length of the bag at the closed bottom end is folded into overlying relationship with the central body portion of the bag. Following filling of the bag, the top end is closed and sealed and then folded over to retain the food in the central portion of the bag adjacent the heat enhancer. Reference may be made to FIGS. 6, 7 and 10 in U.S. Pat. No. 5,326,576, to Zuege, which illustrates typical steps during the manufacturing process.

As the food contained in the bag cooks and expands, the gusseted side panels fold outwardly and the front and back panels move away from one another to enlarge the interior of the bag. Simultaneously, and as described more fully hereinafter, the closed top end of the bag partially opens to define a vent to enable escape of gases, steam and the like from the interior of the bag during cooking of the food therein.

As seen best in FIGS. 6 and 7, the bag is of multiple ply construction and includes an inner grease-resistent layer or ply 18 and an outer layer or ply 19 of machine-finished paper for receiving high quality graphics. The microwave susceptor 17 is positioned between the plies 18 and 19 and extends over substantially the entire central portion of the front panel 11.

Strips of adhesive 20 and 21 are applied along the top and bottom edges of the multiple ply sheet used to form the bag to seal and hold the top and bottom ends of the bag closed when the panels are folded upon one another and pressed together. Similarly, a strip of adhesive 22 is applied along one end edge of one of the panel portions 12*a* or 12*b* of the back panel 12, and the free outer edges of these panel portions are brought into overlapping relationship during manufacture of the bag and pressed together to secure the strip of adhesive 22, forming a back seam 23 to complete the construction of the bag.

The strips of adhesive 20, 21 and 22 may comprise any suitable commercially available material and may be thermosetting or thermoplastic, so long as the bottom seal remains intact and does not open during or after cooking of the food, but which enables the top seal to be opened by grasping the corner flaps formed by the gusseted side panels and the front and back panels, respectively, to open the bag in a conventional manner. Moreover, the adhesively secured top end of the bag should open slightly to form a vent during cooking of the food in the bag.

All of the structure thus far described is of substantially conventional construction and is performed on conventional bag machines. As normally practiced, the bag is made in stages, i.e., suitable graphics are first printed on the outer layer or ply, which is then laminated to the inner layer with the microwave susceptor sandwiched therebetween. The roll stock thus produced is put on a bag machine and liquid adhesive is applied to form the strips 20, 21 and 22. The panels are then folded over one another and pressed together to make the gussets and the back seam 23.

In accordance with the present invention, the foregoing conventional bag construction is very simply and economically modified by the application of spots of adhesive 24 and 25 to the back panel portions 12*a* and 12*b* in positions determined to lie immediately adjacent the diagonal folds 26 and 27 that will form between the expanding portions of the gusseted side panels and the secured end portions thereof when the bag expands during cooking of the food therein. The spots of adhesive are located between the back panel and the corner flap panels at the closed bottom end of the bag so as not to interfere with filling of the bag or opening of it after the food has been cooked. Further, the spots of adhesive are in the back panel, opposite to the front panel containing the susceptor.

Thus, when back panel portions 12*a* and 12*b* are folded inwardly over side panel portions 13*a* and 14*a*, the spots of adhesive 24 and 25 will secure the panel portions together, preventing the formation of pockets between these panel portions when the bag is expanded as shown in FIGS. 1, 2, 4 and 5.

Two additional spots of adhesive 28 and 29 may be provided on the front panel 11 for cooperation with gusseted side panel portions 13*b* and 14*b* to additionally secure the side panel portions to the front panel, but this is not necessary since adhesion of the back panel to the side panel portions will tend to close any pockets that might otherwise form between the front panel and the gusseted side panel portions. However, provision of the additional spots of adhesive 28 and 29 will ensure against the migration of any food particles into any space that might tend to develop between the front panel and the gusseted side panel portions in the area of corner flaps 30 and 31 or 32 and 33 (see FIGS. 2 and 4).

It should be noted that suitable indexing means (not shown) may be provided on the bag so that the position of the mitre spots 24 and 25 may be automatically adjusted by repositioning the adhesive applying means (not shown) during manufacture of the bag to compensate for minor variations in bag dimensions or placement of the fold lines 26 and 27. Additionally, or in lieu thereof, the mitre spots of adhesive 24 and 25 preferably comprise a flowable adhesive material that enables the adhesive to spread out and accommodate itself to the pressure applied during manufacture of the bag, thereby adjusting itself to slight variations in positioning of the fold lines 26 and 27. Additionally, the mitre spots of adhesive 24, 25 (and 28, 29, if used) may be applied on both of the respective panels which are to be adhesively secured together, whereby an adhesive-to-adhesive contact is effected.

Further, although multiple ply construction has been described and illustrated herein, it should be understood that the invention could equally as well be applied to single ply construction.

The utilization of spots of adhesive rather than diagonal strips or bands simplifies the construction and minimizes the use of material and cost in manufacturing the bag, while at the same time producing a bag whose performance is at least equivalent to that of any bag heretofore produced with the objective of the invention in mind, and whose performance is far superior to any conventional bag not having means for securing together the corner flaps at the gusseted side panels.

While particular embodiments of the invention have been illustrated and described in detail herein, it should be understood that various changes and modifications may be made to the invention without departing from the spirit and intent of the invention as defined by the scope of the appended claims.

What is claimed is:

1. A bag for popping popcorn in a microwave oven, comprising:

a pair of substantially rectangularly shaped front and back face panels having top and bottom ends and opposite side edges;

a pair of opposite side panels coterminous in length with the face panels and joining the opposite side edges of the front and back face panels, said side panels each having a longitudinal accordion pleat therein defining longitudinally extending gusset folds in the side panels;

bag closure means securing the top and bottom ends of the front and back face panels and the gusseted side panels together to close and seal the top and bottom ends of the bag, forming a cooking chamber inside the bag;

said gusseted side panels being expandable about the folds therein during cooking of food in the bag to enlarge the interior volume of the bag, and when unfolded to the expanded position, forming triangularly shaped corner flaps at the junctures of the gusseted side panels and the front and back face panels, respectively, said corner flaps each having a folded edge extending diagonally from the respective side panel toward the adjacent closed end of the bag, and having confronting, contiguous, triangularly shaped surface portions between the respective side panel and the adjoining front and back face panels; and attachment means joining the confronting surface portions between the side panels and at least one of the front and back face panels at least at one end of the bag immediately adjacent the diagonal folded edge and spaced from the adjacent bag closure means to hold the confronting surface portions in contiguous relationship when the bag is fully expanded, thereby preventing the formation of pockets or spaces between the confronting surface portions in which food might otherwise collect.

2. A bag as claimed in claim 1, wherein:

the attachment means comprises a spot of adhesive placed between the confronting surface portions of the respective panels.

3. A bag as claimed in claim 2, wherein: a spot of adhesive is provided on the confronting surface portions between the side panels and the back face panel only at the bottom end of the bag.

4. A bag as claimed in claim 3, wherein: a microwave susceptor is provided in the front panel.

5. A bag as claimed in claim 3, wherein:

the spots of adhesive between the side panels and back panel hold the associated confronting surfaces in contiguous relationship and also control expansion of the side panels so that the confronting surfaces between the side panels and the front panel are also maintained in close relationship to one another.

6. A bag as claimed in claim 2, wherein:

the adhesive comprises a flowable material so that it can spread and adapt itself to the position of the diagonal folded edge during manufacture of the bag.

7. A bag as claimed in claim 1, wherein:

the bag is of multiple ply construction, including a grease-resistant inner ply and a machine-finished outer ply laminated thereto and on which high quality graphics may be applied.

8. A bag as claimed in claim 7, wherein:

a microwave susceptor is laminated between the inner and outer plies of the front panel.

9. A bag as claimed in claim 8, wherein:

the attachment means comprises a spot of adhesive placed between the confronting surface portions of the respective panels.

10. A bag as claimed in claim 9, wherein:

a spot of adhesive is provided on the confronting surface portions between the side panels and the back face panel only at the bottom end of the bag.

11. A bag for popping popcorn in a microwave oven, comprising: a pair of substantially rectangularly shaped front and back face panels having top and bottom ends and opposite side edges;

a pair of opposite side panels coterminous in length with the face panels and joining the opposite side edges of the front and back face panels, said side panels each having a longitudinal accordion pleat therein defining longitudinally extending gusset folds in the side panels;

bag end closure means for securing the ends of the front and back face panels and the gusseted side panels together to close and seal the ends of the bag;

said gusseted side panels being expandable about the folds therein during cooking of food in the bag to enlarge the interior volume of the bag, and when unfolded to the expanded position, forming triangularly shaped corner flaps at the junctures of the gusseted side panels and the top and bottom ends of the front and back face panels, respectively, said corner flaps each having a folded edge extending diagonally inwardly from the juncture of the respective side panel and the adjoining face panel toward an adjacent end of the bag, and having confronting, contiguous, triangularly shaped surface portions between the respective side panel and the adjoining front and back face panels; and attachment means joining the confronting surface portions between the side panels and at least one of the front and back face panels at least at one end of the bag immediately adjacent the diagonal folded edge and spaced from the adjacent bag end closure means to hold the confronting surface portions in contiguous relationship thereby preventing the formation of pockets or spaces between the confronting surface portions in which food might otherwise collect.

12. A bag as claimed in claim 11, wherein:

the attachment means comprises a spot of adhesive placed between the confronting surface portions of the respective panels.

13. A bag as claimed in claim 12, wherein:

a spot of adhesive is provided on the confronting surface portions between the side panels and the back face panel only at the bottom end of the bag.

14. A bag as claimed in claim 12, wherein:

the attachment means is located between the ends of the diagonal folded edge.

15. A bag as claimed in claim 13, wherein:

the spots of adhesive between the side panels and back panel hold the associated confronting surfaces in contiguous relationship and also control expansion of the side panels so that the confronting surfaces between the side panels and the front panel are also maintained in close relationship to one another.

16. A bag as claimed in claim 15, wherein:

the adhesive comprises a flowable material so that it can spread and adapt itself to the position of the diagonal folded edge during manufacture of the bag.

17. A bag as claimed in claim 13, wherein:

the attachment means is located between the ends of the diagonal folded edge.

18. A bag as claimed in claim 11, wherein:

the attachment means is located between the ends of the diagonal folded edge.

* * * * *